US005598771A

United States Patent [19]

Main et al.

[11] Patent Number: 5,598,771

[45] Date of Patent: Feb. 4, 1997

[54] DRY FRUIT BIN FILLING APPARATUS

[76] Inventors: Tim B. Main; Scott C. Main, both of 1030 Gibson Rd., P.O. Box 785, Selah, Wash. 98942

[21] Appl. No.: 512,744

[22] Filed: Aug. 8, 1995

[51] Int. Cl.[6] ..... A23L 1/00; A23N 15/00; B65B 1/04; B65B 39/00

[52] U.S. Cl. ..... 99/489; 99/485; 99/584; 53/64; 53/74; 53/244; 53/245; 53/247; 53/259; 53/473; 53/493

[58] Field of Search ..... 99/485, 489, 484, 99/549, 550, 584; 53/64, 244, 536, 259, 493, 468, 473, 391, 248–250, 245, 74, 247; 198/445, 454, 535, 839, 371.2; 414/798.2, 794.1

[56] References Cited

U.S. PATENT DOCUMENTS

| | | | |
|---|---|---|---|
| 2,896,384 | 7/1959 | Carlsen et al. | 53/59 |
| 3,097,460 | 7/1963 | O'Brien | 53/64 |
| 3,229,444 | 1/1966 | Rouse | 53/245 |
| 3,269,083 | 8/1966 | Marano | 53/64 |
| 3,420,038 | 1/1969 | Crabb | 53/248 |
| 3,932,982 | 1/1976 | Klapp | 53/244 |
| 4,062,168 | 12/1977 | Watts et al. | 53/64 |
| 4,081,096 | 3/1978 | Kupcikevicius | 53/35 |
| 4,194,343 | 3/1980 | Myers et al. | 53/493 |
| 4,329,831 | 5/1982 | Warkentin et al. | 53/537 |
| 4,464,880 | 8/1984 | Peters et al. | 53/493 |
| 4,600,065 | 7/1986 | Morris et al. | 177/123 |
| 4,608,808 | 9/1986 | Ryan et al. | 53/436 |
| 4,875,327 | 10/1989 | Wilde | 53/475 |
| 4,965,982 | 10/1990 | Jasperson et al. | 53/248 |
| 5,159,796 | 11/1992 | Tas | 53/245 |

FOREIGN PATENT DOCUMENTS

| | | | |
|---|---|---|---|
| 0464944 | 7/1991 | European Pat. Off. | B65B 25/04 |
| 1243086 | 6/1967 | Germany . | |
| 600034 | 4/1978 | U.S.S.R. | B65B 25/04 |

*Primary Examiner*—Timothy F. Simone
*Attorney, Agent, or Firm*—Stratton Ballew

[57] ABSTRACT

An apparatus is disclosed for a high speed non-bruising dry bin loader for apples and other produce. A transfer belt receives fruit from an transfer source and transfers fruit to a distribution belt once the transfer belt has accumulated a predetermined, staged pattern of fruit. While fruit is transferred from the transfer belt, the distribution belt reciprocates into a bin, which is held in a sideways loading position. As the distribution belt retracts out of the bin, it discharges its load of fruit. The bin is lowered in pre-determined increments between discharge cycles of the distribution belt, so that the fruit is deposited into the bin one layer at a time.

17 Claims, 9 Drawing Sheets

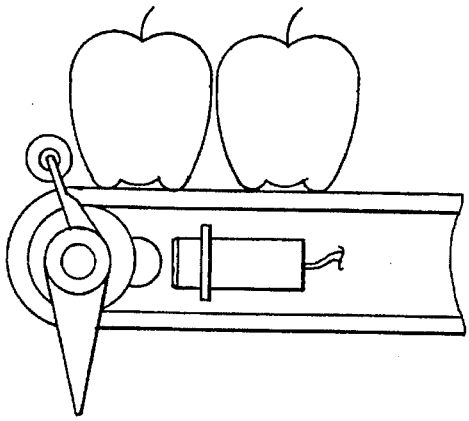
FIG. 14
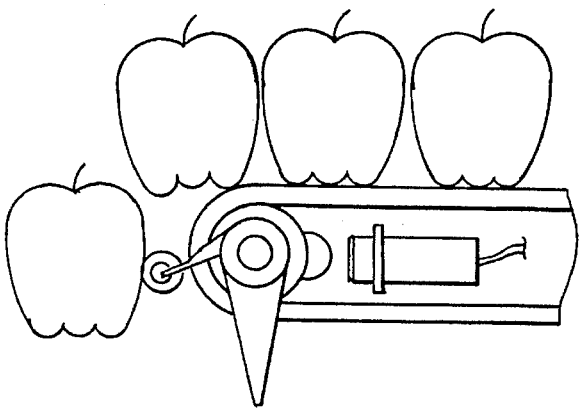
FIG. 15
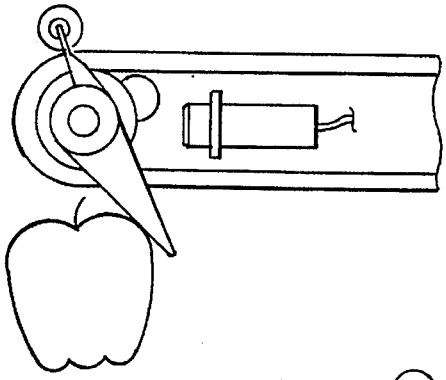
FIG. 16
FIG. 17
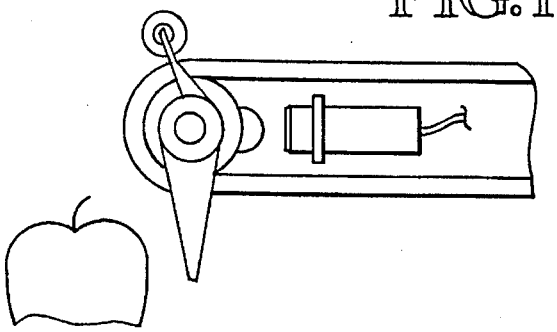

DRY FRUIT BIN FILLING APPARATUS

TECHNICAL FIELD

The invention relates to devices for processing and packaging fruit into containers, and methods for using the same. More specifically, the invention relates to dry conveyance and transfer devices and methods for loading fruits into bins and other containers.

BACKGROUND OF THE INVENTION

Perhaps the most critical factor that determines commercial success or failure in the tree fruit industry is the need for effective, economical methods to process, store and package the fruit prior to sale. This is especially true in diverse fruit industries, such as the apple industry, where wholesale buyers discriminate between as many as twelve sizes, and four color grades, of product for one variety of apple. Such diverse markets call for extraordinarily complex machinery and processes to handle, sort and package the fruit, to satisfy stringent buyer and consumer expectations. In addition to these requirements, most fruit processing and packing operations must meet strict product integrity and wholesomeness standards, which calls for machinery and methods that minimize physical injury and other degradative impacts, such as contamination, of the fruit.

In the apple industry, the methods available for processing and packing fruit are generally limited to two types. The first method is commonly referred to as the "commit to pack" method. In this process, harvested fruit transported from the orchard in bins is emptied from the bin at the processing plant, by submerging the bin in water to gently float the fruit out of the bin. The fruit is then run through conventional washing, waxing and grading machines, and is finally packed into one bushel boxes. In this process, every acceptable piece of fruit that arrives from the orchard is packed into a box. The full boxes are then shipped, or stored as inventory. Because apple sales typically involve only a limited number of available sizes and/or grades of fruit, the packing facility often incurs significant expenses to maintain a large packed inventory. This in turn necessitates a large volume warehouse, because the fruit packed in boxes takes up more space than fruit stored in bins. In addition, because commit to pack facilities must invest capital resources in pre-packing its inventory, such facilities must often liquidate inventory at a lower price than could be obtained at a later date, when particular sizes and grades may be in higher demand. Finally, when pre-packed inventories of fruit are maintained in storage prior to sale, major expenses attributable to spoilage may also be incurred. If an inspector identifies rotting fruit in a single package, the entire lot of fruit must be repacked, greatly increasing the already significant packing costs.

The second general method for processing apples is known as the "presize" method. A presize plant is a large facility which eliminates many of the operating setbacks of commit to pack facilities, but requires a large capital investment to establish and maintain. In a presize operation, laden fruit bins from the orchard are submerged in water, sorted and then re-binned according to size and grade. In this manner, the presize facility is able to maintain an inventory of apples, separated and recorded by size and grade, without committing the up-front cost and warehose volume required in a commit to pack operation. When an order is received, bins of pre-sized and pre-graded apples can be retrieved, and the apples can be inspected and culled at the time of final packing. This maximizes profitability of the facility, by increasing market responsiveness, eliminating repacking requirements, and minimizing storage costs.

Despite the numerous advantages of presize fruit packing, this method suffers a number of significant drawbacks. In the first place, only the largest investors can afford the major capital expenditures required to set up and maintain a presize facility. Presize plants must be housed in exceptionally large buildings, to accomodate the extensive sytems of "hydro-fillers" used to re-bin the sorted apples. These hydro-fillers are the largest piece of equipment in any apple packing facility, measuring about 80 feet in length with their water canals, or flumes. In addition to this large space requirement, presize facilities impose heavy environmental burdens associated with excessive water use and wastewater disposal. When the apples are re-binned, they are suspended in water which must be chlorinated to minimize contamination and spoilage. A great deal of water must be used and disposed of every day of operation. Disposal costs can be so extreme that larger facilities maintain their own wastewater treatment plants. Thus, whereas the capital investment for a typical presize plant begins at about $2.5 to $3.5 million, the costs for maintaining and upgrading such plants can be even greater. Therefore, most independent processors cannot afford presize facilities, and must endure the economic and competitive disadvantages inherent in commit to pack enterprises.

Although the preferred method of fruit processing and packing is to pack only what inventory has been sold, and re-bin the rest for bulk storage by size and grade, them are presently no suitable alternatives to the use of hydro-fillers, as employed in the presize apple packing industry, to accomplish efficient presize processing. Specifically, the use of hydro-fillers allows for rapid, gentle handling and re-binning of the fruit, because water serves as an effective cushion medium to minimize physical damage to the fruit caused by jostling and impacting of the fruit against other fruit and hard processing equipment surfaces. Heretofore there has been no acceptable "dry" process for handling and packing fruit that compares favorably in terms of gentleness to hydro filler methods. Although dry bin fillers are known in the industry, these devices generally result in high levels of fruit rolling, bumping and impacts. Such dry bin fillers typically load fruit into bins positioned at floor level, using conveyor systems which transport fruit into the bins from heights of up to four feet. Control of fruit movement due to dropping, rolling and jostling is limited, resulting in unacceptable levels of bruising which may render the fruit unsaleable. Further, the gentleness of dry bin loading methods is generally a function of the speed at which the loading system operates, so that a dry bin loading system must sacrifice operating rate efficiency to ensure reasonable product quality.

In view of the above, them is an importand need in the tree fruit industry for a fruit processing and packing system that can gently and rapidly transfer damage-succeptible tree fruits, such as apples, into standard shipping and storage bins.

There is an additional need for a fruit processing and packing system which provides comparable gentleness and rapidity of fruit handling as conventional hydro-filler systems, but which eliminates the large capital and space requirements of hydro-filler systems, and obviates the environmental mitigation measures necessary to install and operate such systems.

SUMMARY OF THE INVENTION

It is therefore an object of the present invention to provide a fruit processing and packing system that gently and rapidly transfers delicate tree fruits, such as apples, into standard shipping and storage bins.

It is a further object of the invention to achieve the above objects in a fruit processing and packaging system that rivals conventional hydro-filler systems in terms of gentleness and rapidity of fruit handling, but at the same time eliminates the excessive capital and space requirements of hydro-filler systems, and avoids the environmental problems which attend the use of such systems.

The invention achieves these objects and other objects and advantages which will become apparent from the description which follows by providing high speed, gentle handling dry bin loader for apples and other produce. The bin loader features a frame supporting a fruit transfer belt, which receives from a fruit transfer source. The transfer belt feeds fruit to a distribution belt located the transfer belt. The distribution belt is adapted to reciprocate into and out of a fruit bin held in a sideways bin loading orientation. As the distribution belt reciprocates into the bin, it receives apples from the transfer belt. As the distribution belt reciprocates out of the bin, the belt begins to rotate in a forward direction, thereby discharging fruit from the end of the belt into the bin. During this activity, the transfer belt ceases motion, and transfer of fruit to the distribution belt is interrupted. Control of distribution belt reciprocation is integrated with control of driving and rotational mechanisms for the transfer belt and distribution belt, respectively, so that the transfer belt is driven at a rate that approximates a concurrent, forward reciprocation rate of the distribution belt, and so that the distribution belt rotates at a rate that substantially matches a concurrent, rearward reciprocation rate of the distribution belt.

In preferred embodiments of the invention, the bin is raised and lowere automatically with respect to the distribution belt, so that the fruit is deposited from the distribution belt into the bin gently, layer by layer. Accordingly, the loader can be equipped with vertical bin position sensing means that are operatively coupled with vertical bin position adjustment means. The sensing means determine a vertical position of the bin relative to the distribution belt and provide a signal effective to automatically regulate vertical positioning of the bin relative to the distibution belt, between successive distribution belt discharge cycles. In this manner, the bin can be automatically positionally adjusted before each distribution belt discharge cycle, to provide a vacant bin space directly below the distribution belt which is approximately the same height as layer of fruit being loaded.

In other preferred embodiments of the invention, the transfer belt transfers fruit to the distribution belt only alter the transfer belt has accumulated a predetermined, staged pattern of fruit. To achieve this objective, the bin filler is provide with a staged fruit pattern sensor mounted above the transfer belt, which senses a staged pattern of fruit on the transfer belt. The fruit pattern sensor is operatively interconnected with the transfer belt drive mechanism, so that the transfer belt is only driven forward when the end of the transfer belt has accumulated at least one complete, staged row of fruit. This ensures that fruit is transferred from the transfer belt to the distribution belt in complete rows, to optimally fill the awaiting bin. At the same time, this design ensures that successive rows of fruit are transferred in an extremely gentle manner, without changing relative forward or lateral positions, and preferably without significantly disturbing angular orientation of the fruit, relative to original angular orientation of the fruit when it was originally staged on the transfer belt. By virtue of this integrated loading system design, the original pattern of fruit accumulated on the transfer belt is "translated" with optimal conservation from the transfer belt, to the distribution belt, and then into the bin, layer by layer, with minimal jostling and bruising.

DETAILED DESCRIPTION OF THE PREFERRED EMBODIMENTS

Figure 1:
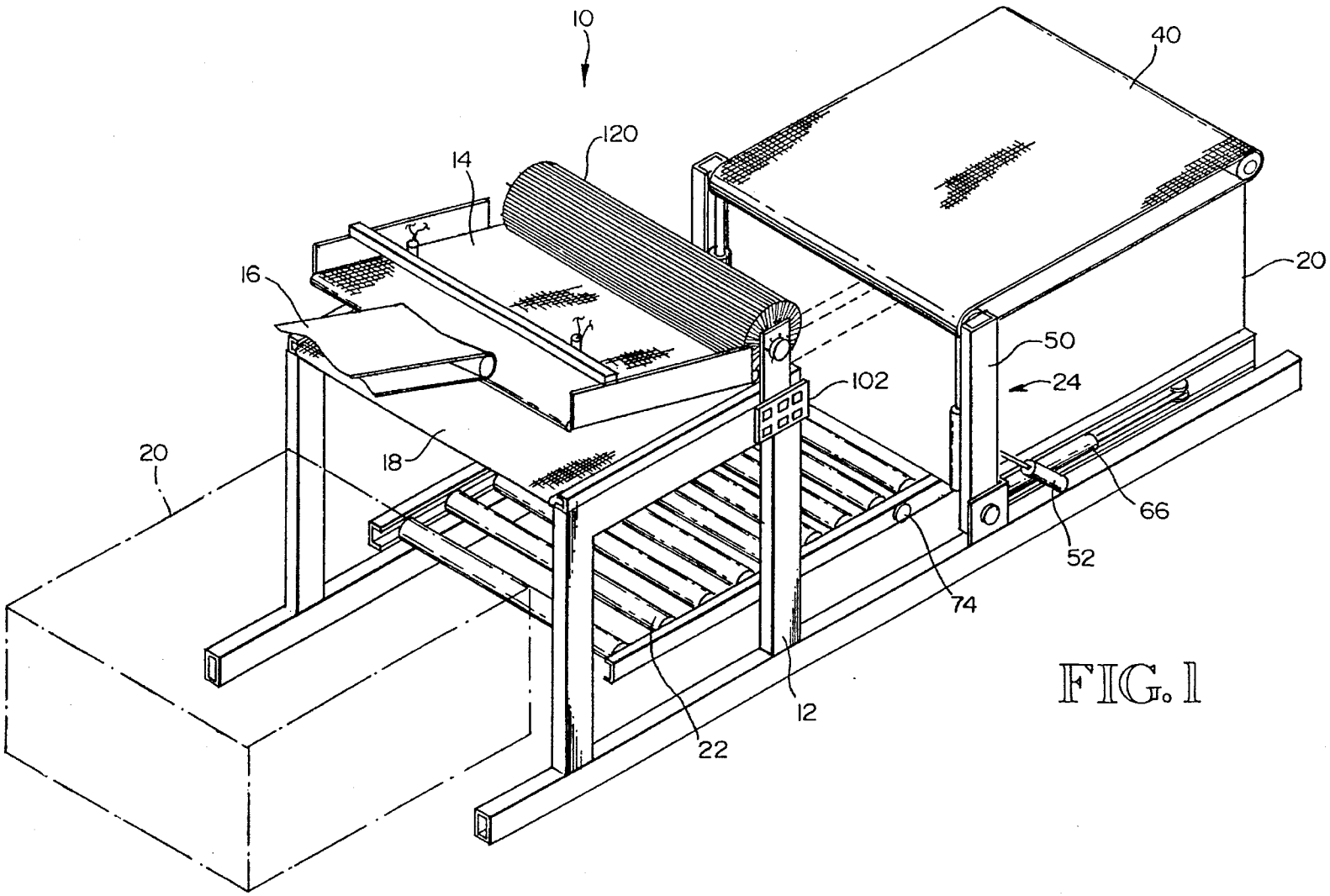

A dry fruit bin loading device employing the concepts of the present invention is generally indicated at reference numeral 10 in FIG. 1. The bin loader includes a frame 12 supporting a fruit transfer belt 14, which receives from a fruit transfer source 16. The frame is of sturdy construction, preferably fabricated from rectangular steel elements. The overall size of the loading device, including the frame, is compact, generally less than 16 feet, and preferably as small as 12 feet in length, to minimize spacial requirements. The loading device is adapted for compatable installation into existing limit processing and loading plants, with installation generally limited to simple placement of the device in line with an existing fruit transfer source 16.

The frame 12 of the fruit loading device 10 also supports a fruit distribution belt located beneath the transfer belt 14, positioned and dimensioned to receive fruit from the transfer belt. Both the transfer belt and distribution belt are designed with a preferred belt width somewhat less than an average width of a conventional fruit bin, for example a conventional apple bin having general length and width dimensions of 47×47 inches. However, most fruit bins have corner reinforcements which occupy interior space of the bin, which mandate preferred belt widths slightly less than minimal bin interior dimensions. In the case of apple bins, the minimal bin dimensions are about 42×42 inches, suggesting a preferred width of the transfer and distribution belts of approximately 39 inches.

Figure 2:
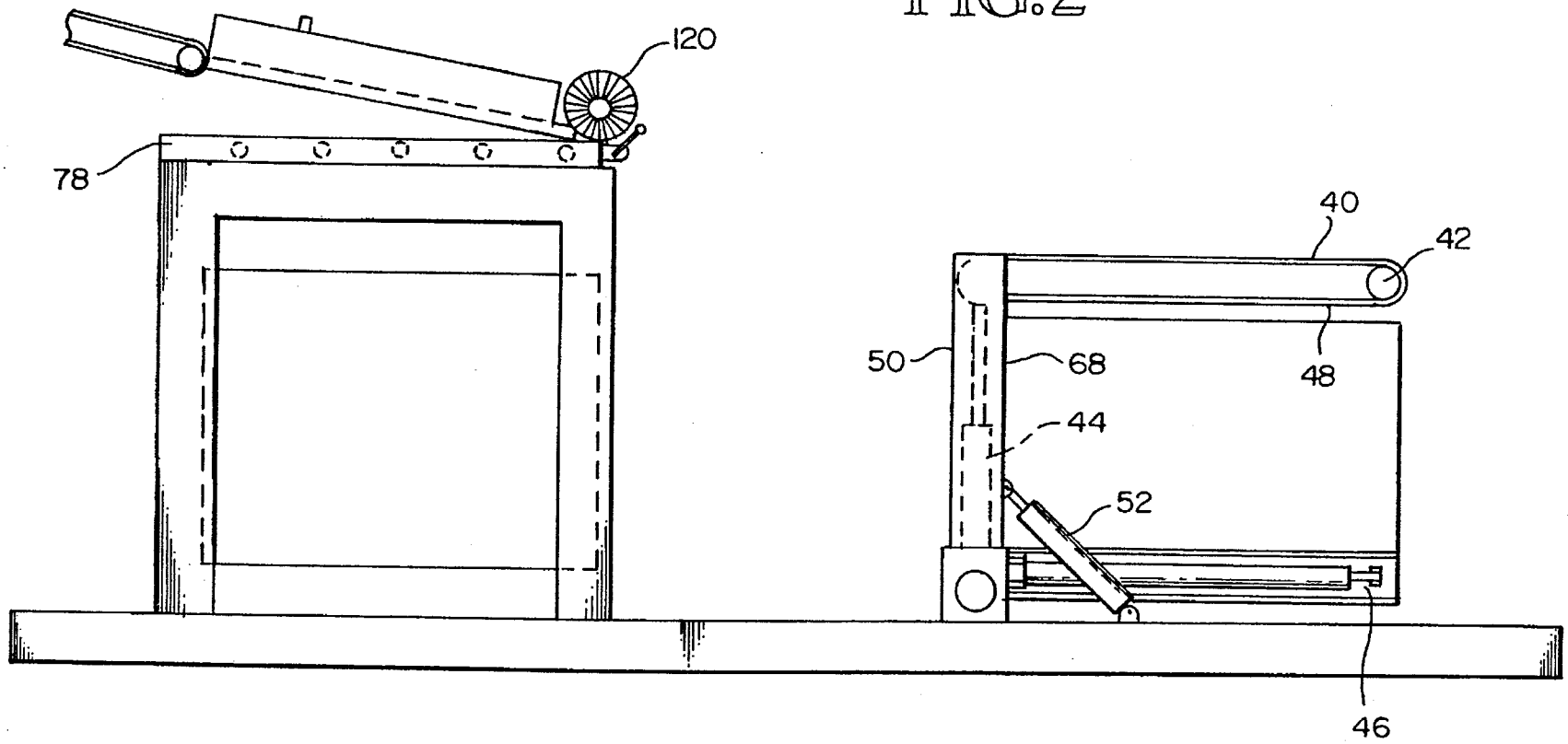
Figure 3:
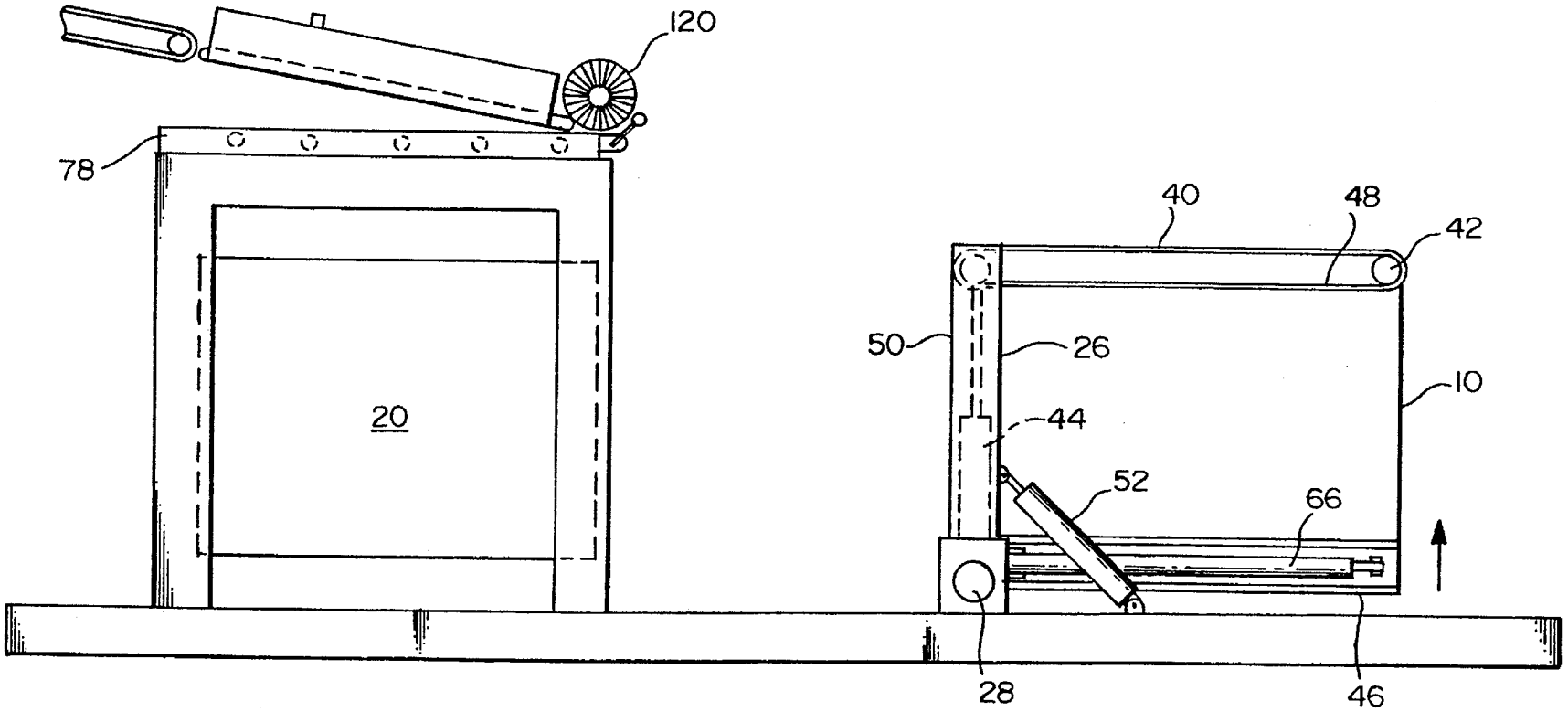
Figure 4:
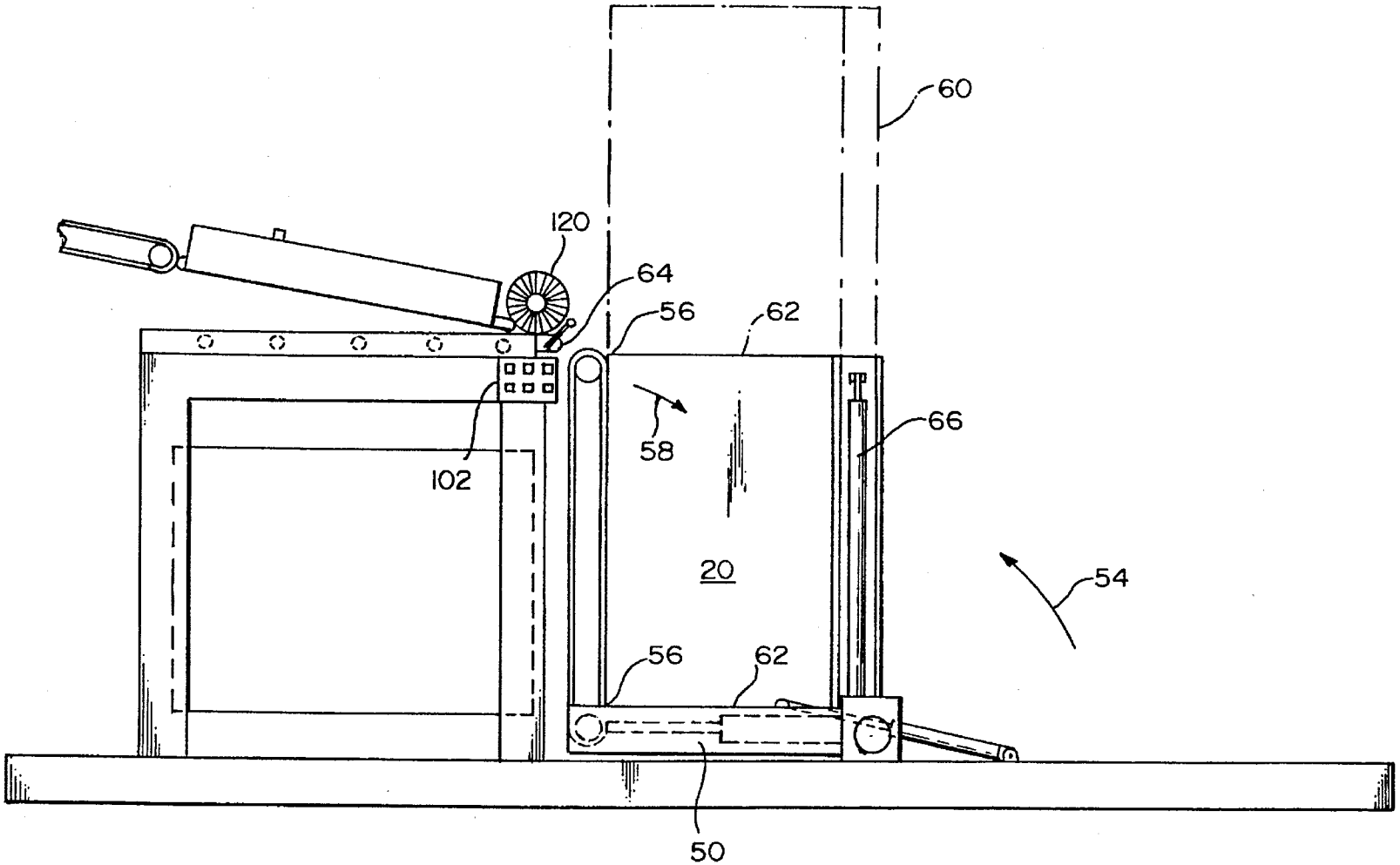

In a preliminary stage to a bin loading operation, a fruit bin 20 is brought into an appropriate position relative the bin loading device 10, preferably by rolling the bin from the rear of the frame atop rollers 22 within a bin staging enclosure defined by the frame. In preferred embodiments of the invention, the bin is then advanced to a bin receiving and rotating mechanism, generally indicated at reference numeral 24 in FIG. 1, positioned forward of the frame. The bin receiving and rotating mechanism is designed to receive a newly introduced fruit bin, and to rotate the bin from an upright orientation to a substantially sideways, bin loading orientation before bin loading commences. As shown in FIGS. 2–4, the bin receiving and rotating mechanism preferably includes a fruit bin holder 26 pivotally attached to the frame at a lower pivot point near the lower edge of the holder nearest the frame. The bin holder is adapted to receive the bin within a framework of the holder.

Action of the bin receiving and rotating mechanism is illustrated successively between FIGS. 2–4. In FIG. 2, a bin has been staged and advanced into the bin holder. Optionally, the holder is integrated with a top clamping element, preferably a rotating fruit bin cover 40 rotatably mounted on a pulleyed track 42, positioned directly above the bin. A fundamental purpose of this clamping element is to clamp the bin into place prior to rotating the bin into the sideways loading position. To accomplish this, the bin holder has a first bin elevating piston 44 which raises the bin, along with a lower holder frame element 46, and snugs the bin up against a bottom surface 48 of the rotating bin cover. This action is facilitated by a telescoping design of a side frame element 50 of the bin holder, which is preferably constructed of nested steel elements having a square, c-shaped cross section resembling nested forklift towers.

Once the bin is properly positioned in the bin holder, the holder and bin is then rotated by a bin rotating piston 52 extending between the holder and frame, which rotates the bin and holder along the direction of the arrow 54 shown in FIG. 4. This positions the bin in an appropriate, sideways orientation for loading of the bin. While it is satisfactory to load the bin in a completely sideways position, i.e. with a plane defined by a top corners 56 of the bin coincident with the vertical plane, it is actually preferred to orient the bin between 0 degrees and 10 degrees off of the vertical plane, angularly biased in the direction of arrow 58, to prevent fruit from shifting toward the top of the bin after it has been loaded.

The next stage in commencement of the bin loading operation is to elevate the sideways oriented bin relative to the distribution belt 18, so that loading of the bin commences with the bin positioned at a highest loading position 60 (represented in phantom lines in FIG. 4), with a lowest positioned side 62 of the bin in approximate vertical register with a discharge end 64 of the distribution belt. This bin elevation operation is preferably accomplished by extension of a second bin elevating piston 66, which raises the bin along with the side frame element 50 of the holder. This action is facilitated by a telescoping design of the lower element 46 of the holder frame element, which is also preferably constructed of nested, c-shaped steel elements.

The pistons which control bin receiving and rotation are preferably standard hydraulic pistons motivated by conventional hydraulic pumps, which maximize responsivity and fluidity of motion of the loading device. These pistions are in turn preferaby controlled, both temporally and in terms of the direction and extent of their motion by a standard programmable logic chip (PLC).

Figure 5:
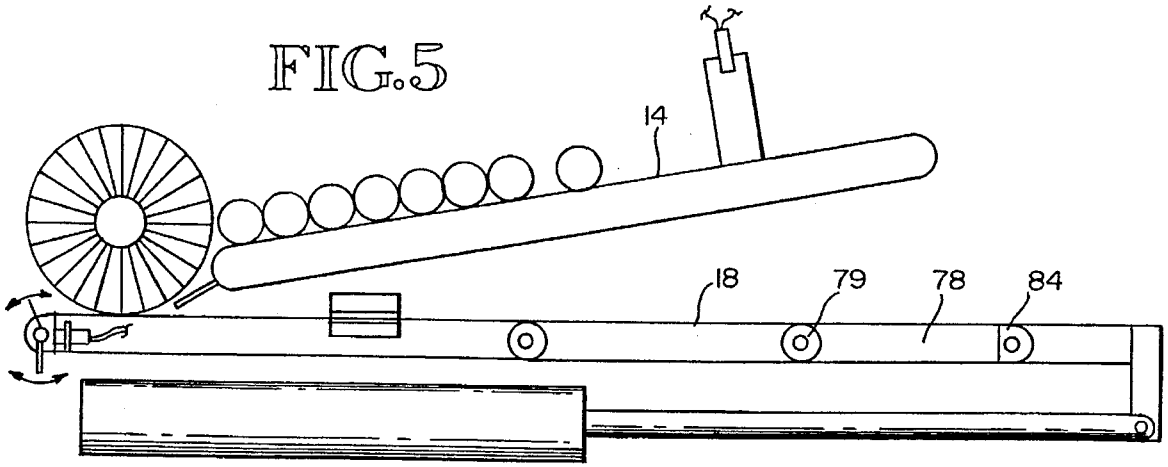
Figure 6:
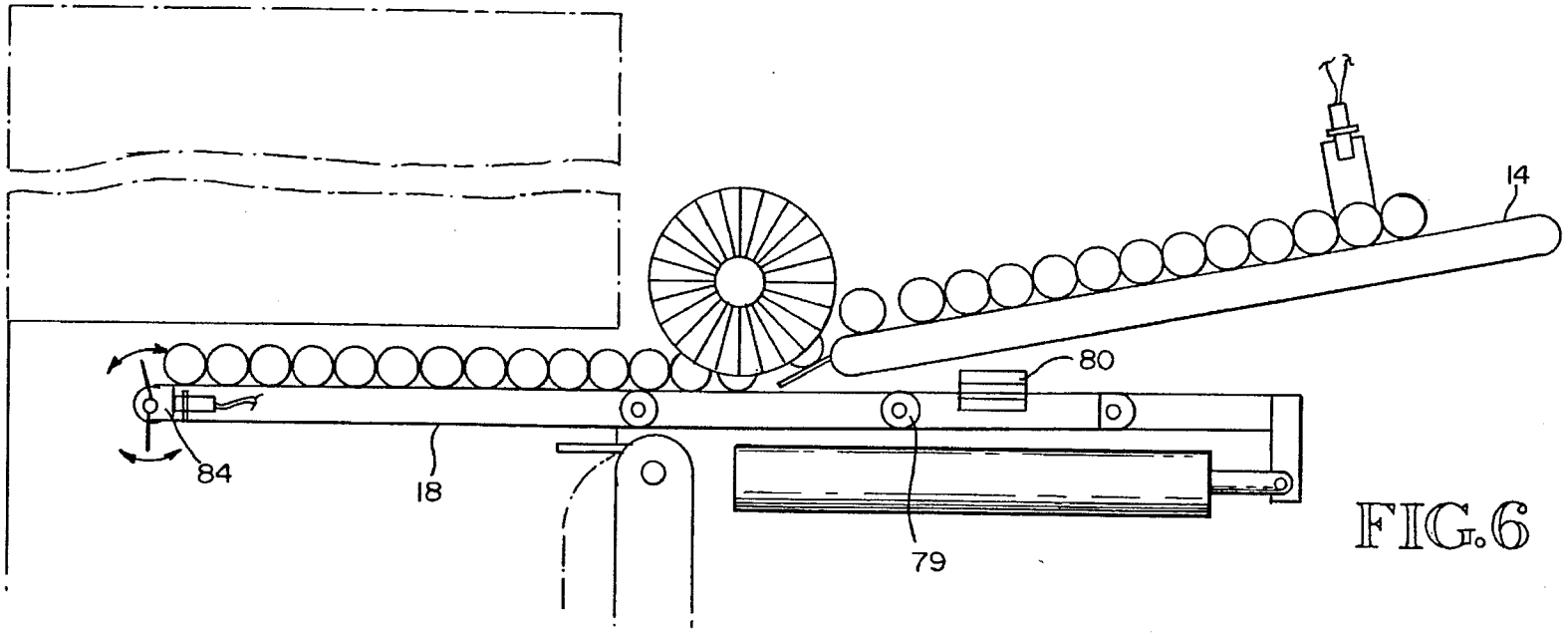
Figure 7:
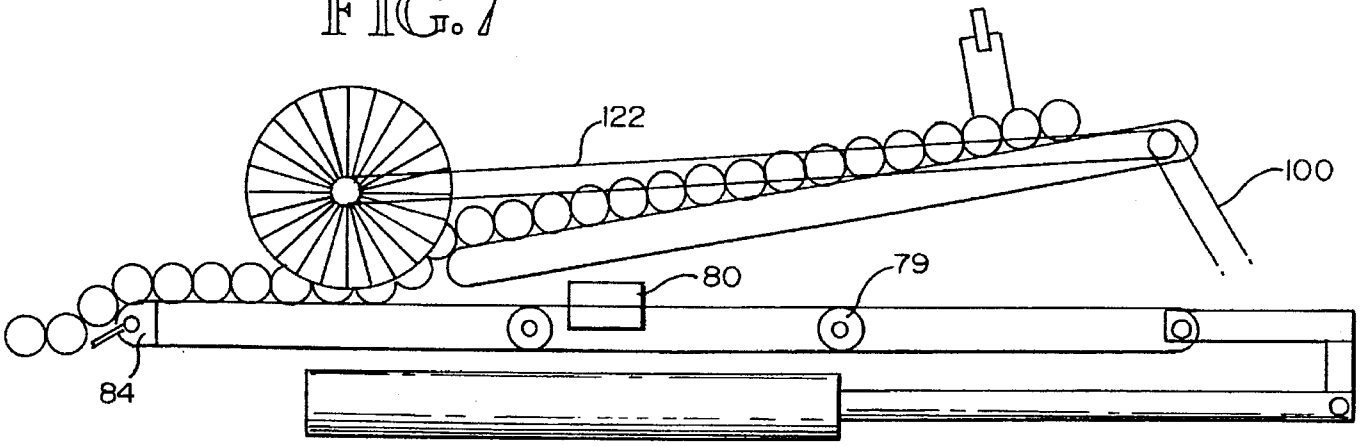

Once the bin is properly oriented and raised to begin loading, the transfer belt 14 and distribution belt are activated, also preferably by the PLC, to commence transfer of apples from the transfer belt to the distribution belt, and to soon after begin loading of apples from the distribution belt into the bin. The distribution belt 18 is adapted to reciprocate into and out of the fruit bin when the bin is held in the sideways bin loading orientation. As the distribution belt reciprocates into the bin, it receives apples from the transfer belt. As the distribution belt reciprocates out of the bin, the belt begins to rotate in a forward direction, thereby discharging fruit from the end of the belt into the bin. Reciprocating movement of the distribution belt is generally depicted in FIGS. 5–7. During this activity, the transfer belt ceases motion, and transfer of fruit to the distribution belt is interrupted.

Figure 9:
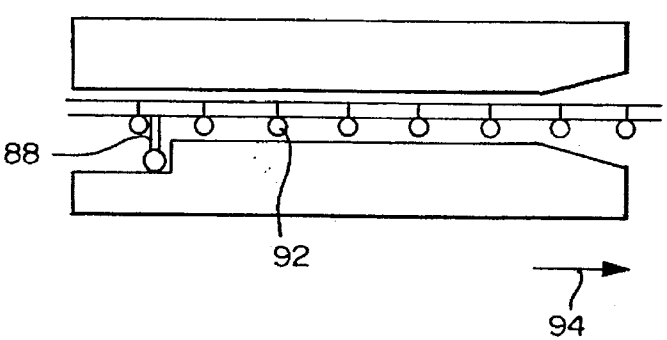
Figure 8:
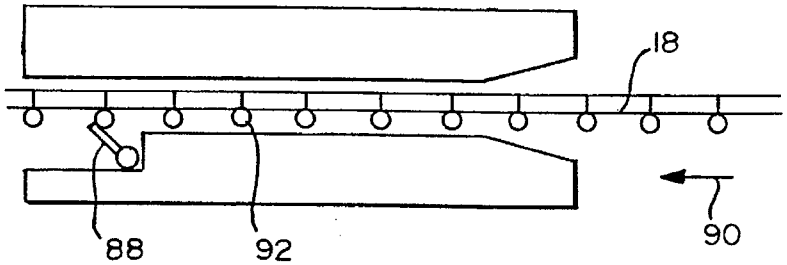

Bidirectional reciprocating movement of the distribution belt 18 involves an intermittently operable, distribution belt rotating mechanism, which preferably includes a distribution belt carriage 78 slidably mounted on tracked rollers 79 to the frame, and rotatably supporting the distribution belt (see FIGS. 5–7). The carriage has a forward and rearward carriage reciprocating mechanism for bi-directionally reciprocating the carriage and distribution belt relative to the transfer belt 14. This recipricating mechanism preferably includes a one-way distribution belt clutch 80 fixedly mounted relative to the frame. As exemplified in one embodiment in FIGS. 8 and 9, the clutch is designed to fixedly engage the distribution belt during rearward reciprocation of the distribution belt and belt carriage, and thereby translate rearward reciprocational movement of the carriage into forward rotational movement of the distribution belt around terminal, transitional surfaces (eg. end rollers or D-shaped end plates 84 for the belt to slide over) of the carriage during a discharge cycle of the distribution belt. The distribution belt clutch is further designed to disengage the distribution belt during forward reciprocation of the distribution belt and belt carriage, to discontinue rotation of the distribution belt during a loading cycle of the distribution belt. To achieve these results, the clutch embodiment depicted in FIGS. 8 and 9 features a forwardly spring biased, upwardly depending arm 88 that permits forward motion of the belt 18 in the direction of arrow 90, but can engage the lower surface of the belt, eg. by engaging lower protrusions 92 depending downwardly from the belt, and thereby prevent rearward movement of the belt in the direction of arrow 94.

Control of distribution belt reciprocation is integrated with control of driving and rotational mechanisms for the transfer belt and distribution belt, respectively. Driving mechanisms for the transfer belt, preferably an intermittently operable, conventional chain drive 100, and preferably regulated a multi-task PLC 102, so that the transfer belt is driven at a rate that approximates a concurrent, forward reciprocation rate of the distribution belt, and the distribution belt rotates at a rate that substantially matches a concurrent, rearward reciprocation rate of the distribution belt.

In preferred embodiments of the invention, the bin 20 is lowered automatically, incrementally during a loading operation, from the highest loading position, to a lowest loading position (indicated at reference numeral 70 in FIG. 6) when the distribution belt is approximately in vertical register with the top of the bin. This is accomplished by a dynamic, vertical bin position adjustment mechanism, preferably the second bin elevating piston 66, which dynamically adjusts the vertical position of the bin relative to the distibution belt between successive distribution belt discharge cycles. Preferably, the second elevating piston is actuated incrementally to precisely positionally adjust the bin before each distribution belt discharge cycle, to present a vacant bin space directly below the distribution belt having approximately the same height as a height dimension of a selected fruit product to be loaded. The vacant bin space can be between the distribution belt lower surface, and either the bottom of the bin or the topmost surface of a last-deposited layer of fruit already loaded into the bin. To control the vertical bin position adjustment, vertical bin position sensing devices 74 can also provided to detect the vertical position of the bin. These devices can be ultrasound or other proximity sensors suitable for detecting bin proximity within the range of bin position useful in the invention. These sensors can further be operatively interconnected with the vertical bin position adjustment mechanism, eg. piston 66, preferably via a PLC, to provide a signal integrated by the PLC to to correctly, automatically regulate vertical positioning of the bin relative to the distibution belt between successive distribution belt discharge cycles. In this manner, the bin can be automatically precisely positioned before each distribution belt discharge cycle, to present a vacant bin space directly below the distribution belt having approximately the same height as the height of selected fruit items being loaded.

Figure 10:
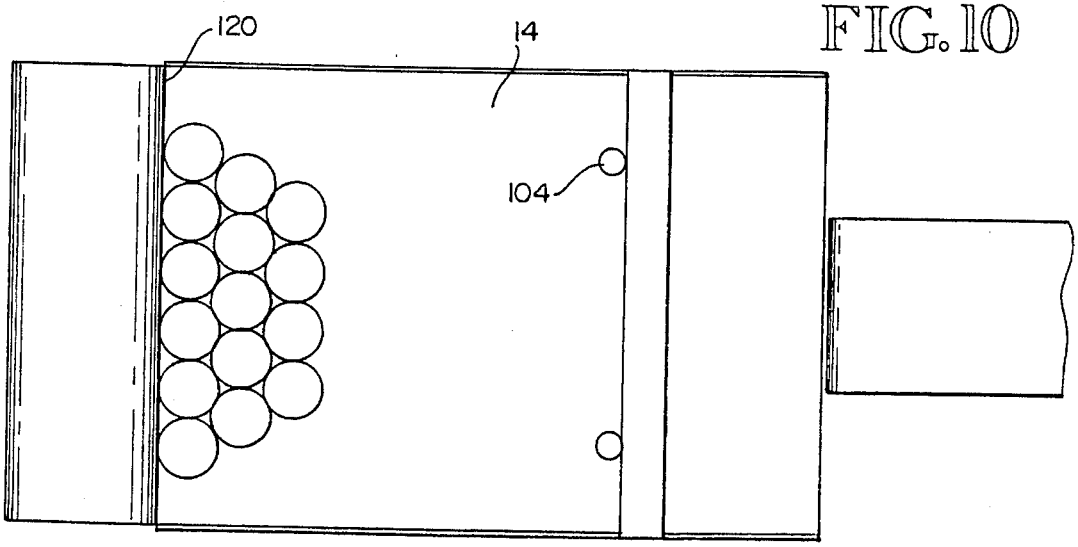
Figure 11:
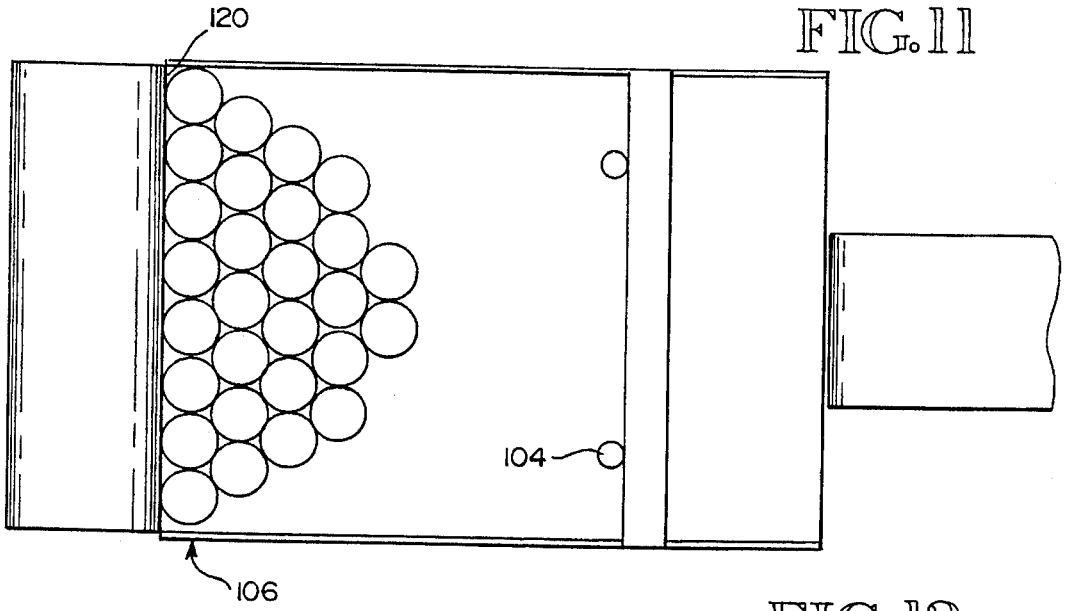
Figure 12:
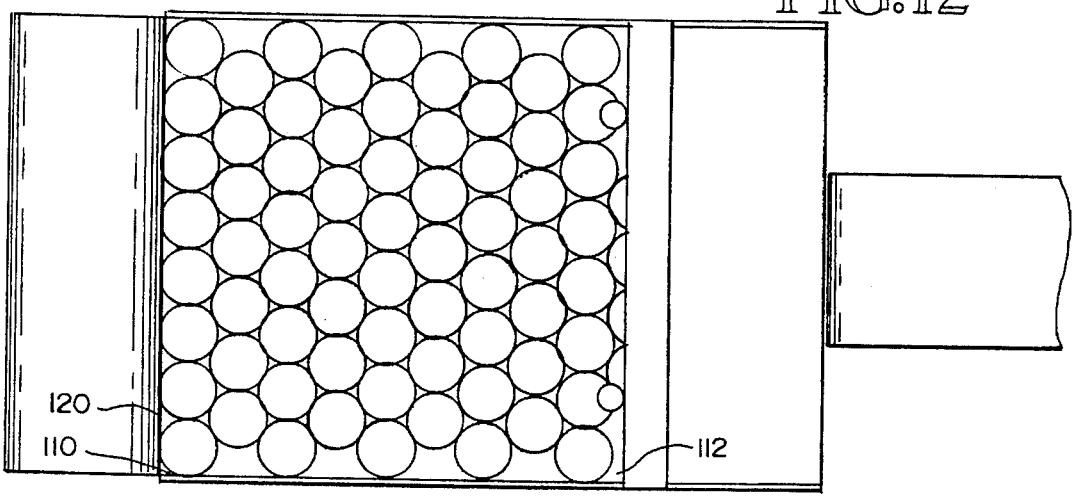
Figure 13:
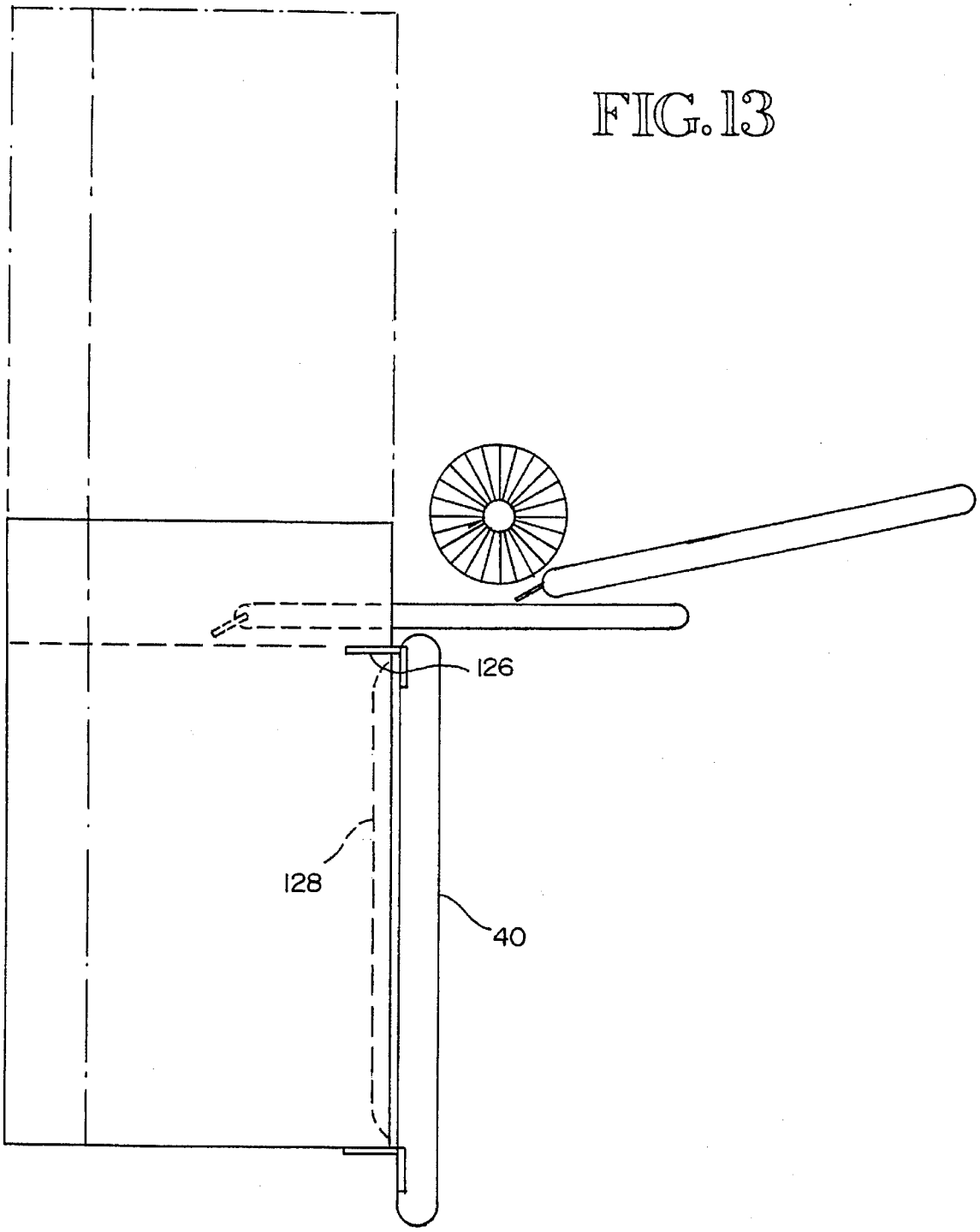

In other preferred embodiments of the invention, the transfer belt 14 transfers fruit to the distribution belt 18 only after the transfer belt has accumulated a pre-determined, staged pattern of fruit, illustrated in FIGS. 10–12. To achieve this objective, the bin filler is provided with a staged fruit pattern sensor mounted above the transfer belt, which senses a staged pattern of fruit on the transfer belt. The fruit pattern sensor is operatively interconnected with the transfer belt drive mechanism 100, so that the transfer belt is only driven forward when the end of the transfer belt has accumulated at least one complete, staged row of fruit (as indicated by arrow 106 in FIG. 11). This ensures that limit is transferred from the transfer belt to the distribution belt in complete rows, to optimally fill an awaiting bin. At the same time, this design ensures that successive rows of fruit are transferred in an extremely gentle manner, without changing relative forward or lateral positions, and preferably without significantly disturbing angular orientation of the fruit, relative to original angular orientation of the fruit when it was originally staged on the transfer belt. By virtue of this integrated loading system design, the original pattern of fruit accumulated on the transfer belt is "translated" with optimal conservation from the transfer belt, to the distribution belt, and then into the bin, layer by layer, with minimal jostling and bruising.

A preferred type of staged fruit pattern sensor 104 is a photoelectric cell with a fixed focal range for detecting objects within a pre-determined focal distance. The loading device is designed so that the transfer belt 14 is tilted on a slight angle, preferably about 10 degrees with a discharge end 110 of the transfer belt slightly lower than the rear, fruit receiving end 112 of the belt. With this design, fruit rolls down the transfer belt and naturally accumulates at the discharge end in a pyramidal, staged pattern, illustrated in FIGS. 10–12. Accumulatation of fruit in a staged pattern at the discharge end of the belt is partially regulated by a rotary transition brush 120 rotatatably mounted to the frame 12 above and between the transfer belt and distribution belt, which stops gravitational movement of the fruit and also facilitates gentle transfer of fruit from the transfer belt to the distribution belt. The latter function is facilitated by a transition brush rotational drive mechanism, preferably a chain drive 122, slavedly connected to the transfer belt drive means, which rotates the brush rotates synchronously with forward driving of the transfer belt.

The staged fruit pattern sensor 104 is preferably mounted above the transfer belt to facilitate sensing of a pre-selected, staged pattern of fruit on the transfer belt. The fruit pattern sensor is also preferably operatively interconnected with the transfer belt drive means by the multi-task PLC 102, so that the transfer belt is only driven in a forward direction when the discharge end 110 of the transfer belt bears a complete, staged row 106 of fruit. The fruit pattern sensor is specifically designed to monitor the presence or absence of an item of fruit, at a pre-determined, terminal staging position on the transfer belt. Choice of the pre-determined terminal staging position depends on a number of factors, including size and shape of fruit and angle of the transfer belt, among others. In the case of apple loading, a satisfactory terminal staging position to guarantee that a complete row of fruit is staged before the transfer belt is activated, using photosensors, is is set back from the discharge end of the transfer belt at least a distance corresponding to a combined width of three staged rows of apples, approximately 7.5–15 inches, depending on the size of apples being staged. More preferably, the pre-determined stagin position is offset at least two inches from a midline of the transfer belt, and is set back at least 10 inches from the discharge end of the transfer belt (laterally offsetting the sensor minimizes false triggering of the sensor by apples that tend to roll down the middle of the transfer belt). An even more preffered terminal position monitored by the photoelectric sensor is offset approximately eight inches from a midline of the transfer belt and is set back approximately 25 inches from the discharge end of the transfer belt (this minimizes starting and stopping of the PLC controlled transfer belt, so that a full distribution belt load, corresponding to a full fruit layer in the bin, can be translated from the transfer belt to the distribution belt in one cycling activity.

In alternate embodiments of the invention, the dry fruit bin loader includes a rotating fruit bin cover 40 rotatably mounted on a pulleyed cover track 42, with a bottom surface 48 of the cover closely juxtaposed to a top of the bin when the bin is in the lowest loading position 70. The cover track has a length and width corresponding approximately the same as the length and width dimensions of the top of the bin, and is vertically fixed in position relative to the frame during the bin loading operation. The cover itself is positionally fixed relative to a vertical position of the bin, for example by bolting the cover by a bolt 126 to an element of the bin holder, so that vertical adjustment of the bin position between successive distribution belt discharge cycles is translated into rotational movement of the cover around end pulleys of the cover track. This holds the loaded apples in the bin while leaving the unloaded portion of the bin uncovered to allow entry of the distribution belt. The cover preferably has a pad 128 vulcanized to the bottom surface to preserve a clear space at the top of the loaded bin, to prevent fruit damage from bin stacking.

In further alternate embodiments, the invention includes a loaded fruit sensor, shown in FIGS. 12–15. The fruit sensor is preferably connected to the distribution belt and senses vertical proximity between a loaded item of fruit in the bin, and the distribution belt. The loaded fruit sensor is also operatively interconnected with the vertical bin position adjustment means by the multi-task PLC 102, and is capable of providing a signal effective to automatically regulate vertical positioning of the bin to present a vacant bin space between the distribution belt and the loaded fruit item having approximately the same height as a height dimension of the loaded fruit item. Ideally, the loaded fruit sensor means is connected to an underside of a discharge end of the distribution belt, and is activated by physical contact with the loaded fruit item.

Those with ordinary skill in the art will appreciate that other embodiments and variations of the invention are possible which employ the same inventive concepts described above. Therefore, the invention is not to be limited except by the above description, but is to be determined in scope by the claims which follow.

We claim:

1. A dry fruit bin filler for rapidly filling standard-sized fruit bins with fruit, while minimizing bruising damage to the fruit, comprising:

a frame supporting a fruit transfer belt, the transfer belt adapted to receive fruit from a fruit transfer source and having a belt width approximately the same as a minimum width of a standard fruit bin;

a fruit distribution belt supported by the frame below the transfer belt, the distribution belt positioned and dimensioned to receive fruit from the transfer belt;

bi-directional, distribution belt reciprocating means for bi-directionally reciprocating the distribution belt relative to the transfer belt, the reciprocating means functional to successively advance, then retract the distribution belt toward, then away from, a bottom of a fruit bin positioned forward of the frame in a sideways bin loading orientation during a bin loading operation;

intermittently operable, transfer belt drive means for driving the transfer belt in a forward direction while the distribution belt reciprocates toward the bottom of the bin, and for discontinuing driving of the transfer belt while the distribution belt reciprocates away from the bottom of the bin;

intermittently operable, distribution belt rotating means for rotating the distribution belt in a forward direction while the distribution belt reciprocates away from bottom of the bin, and for discontinuing rotation of the distribution belt while the distribution belt reciprocates toward the bottom of the bin; and belt control integration means for integrating control of distribution belt reciprocation with transfer belt driving and distribution belt rotation, so that the transfer belt is driven at a rate that substantially matches a concurrent, forward reciprocation rate of the distribution belt, and the distribution belt is rotated at a rate that substantially matches a concurrent, rearward reciprocation rate of the distribution belt.

2. The dry fruit bin filler of claim 1, including bin receiving and rotating means positioned forward of the frame for receiving a newly introduced fruit bin, and for rotating the bin from an upright orientation to the sideways loading orientation before the bin loading operation commences.

3. The dry fruit bin filler of claim 2, wherein the bin receiving and rotating means include a fruit bin holder pivotally attached to the frame at a lower edge of the holder nearest the frame and adapted to receive the bin within a framework of the holder, the holder having a piston extending between the holder and frame for rotating the bin holder into the sideways loading orientation.

4. The dry fruit bin filler of claim 1, wherein the sideways loading orientation of the bin corresponds to orientation of an open top of the bin between 0 degrees and 10 degrees off of vertical.

5. The dry fruit bin filler of claim 1, including dynamic, vertical bin position adjustment means for dynamically adjusting a vertical position of the bin relative to the distibution belt between successive distribution belt discharge cycles, so that the bin can be dynamically, positionally adjusted before each distribution belt discharge cycle to present a vacant bin space directly below the distribution belt having approximately the same height as a height dimension of a selected fruit product to be loaded.

6. The dry fruit bin filler of claim 5, including vertical bin position sensing means operatively interconnected with the vertical bin position adjustment means for sensing a vertical position of the bin relative to the distribution belt, the bin position sensing means capable of providing a signal effective to correctly, automatically regulate vertical positioning of the bin relative to the distibution belt between successive distribution belt discharge cycles, so that the bin can be automatically positionally adjusted before each distribution belt discharge cycle to present a vacant bin space directly below the distribution belt having approximately the same height as a height dimension of a selected fruit product to be loaded.

7. The dry fruit bin filler of claim 6, wherein the vertical bin position sensing means include an ultrasound proximity sensor mounted to the frame at a position below the bin when the bin is held in the sideways loading orientation.

8. The dry fruit bin filler of claim 5, including a rotating fruit bin cover rotatably mounted on a pulleyed cover track closely juxtaposed to a top of the bin when the bin is in a lowest, sideways loading orientation, the cover track having a length and width corresponding approximately to length and width dimensions of the top of the bin, the cover track having a vertically fixed position relative to the frame during the bin loading operation, the cover being positionally fixed relative to a vertical position of the bin so that vertical adjustment of the bin position between successive distribution belt discharge cycles is translated into rotational movement of the cover around end pulleys of the cover track.

9. The dry fruit bin filler of claim 1, including staged fruit pattern sensor means mounted above the transfer belt for sensing a staged pattern of fruit on the transfer belt, the fruit pattern sensor means operatively interconnected with the transfer belt drive means so that the transfer belt is only driven in a forward direction when a discharge end of the transfer belt supports a complete, staged row of fruit.

10. The dry fruit bin filler of claim 9, wherein the staged fruit pattern sensor means include a photoelectric sensor capable of monitoring the presence or absence of an item of fruit at a pre-determined, terminal staging position on the transfer belt.

11. The dry fruit bin filler of claim 10, wherein the pre-determined, terminal position monitored by the photoelectric sensor is set back from the discharge end of the transfer belt at least a distance corresponding to a combined width of three staged rows of selected fruit.

12. The dry fruit bin filler of claim 10, wherein the pre-determined position monitored by the photoelectric sensor is offset at least two inches from a midline of the transfer belt and is set back at least 10 inches from the discharge end of the transfer belt.

13. The dry fruit bin filler of claim 10, wherein the pre-determined position monitored by the photoelectric sensor is offset approximately eight inches from a midline of the transfer belt and is set back approximately 25 inches from the discharge end of the transfer belt.

14. The dry fruit bin filler of claim 1, including a rotary transition brush rotatatably mounted to the frame above and between the transfer and distribution belts to facilitate gentle transfer of fruit from the transfer belt to the distribution belt, the transition brush having rotary drive means slavedly connected to the transfer belt drive means so that the brush rotates synchronously with forward driving of the transfer belt.

15. The dry fruit bin filler of claim 1, including loaded fruit sensor means connected to the distribution belt for sensing vertical proximity between a loaded item of fruit in the bin, and the distribution belt, the loaded fruit sensor means operatively interconnected with the vertical bin position adjustment means and capable of providing a signal effective to automatically regulate vertical positioning of the bin to present a vacant bin space between the distribution belt and the loaded fruit item having approximately the same height as a height dimension of the loaded fruit item.

16. The dry fruit bin filler of claim 15, wherein the loaded fruit sensor means are connected to an underside of a discharge end of the distribution belt and are activated by physical contact with the loaded fruit item.

17. The dry fruit bin filler of claim 1, wherein the bi-directional, distribution belt reciprocating means and intermittently operable, distribution belt rotating means include a distribution belt carriage slidably mounted to the frame and rotatably supporting the distribution belt, the carriage having forward and rearward carriage reciprocating means for bi-directionally reciprocating the carriage and distribution belt relative to the transfer belt, and wherein the distribution belt drive means are rendered intermittently operative by a one-way distribution belt clutch fixedly mounted relative to the frame, the clutch designed to fixedly engage the distribution belt during rearward reciprocation of the distribution belt and belt carriage and thereby translate rearward reciprocational movement of the carriage into forward rotational movement of the distribution belt around terminal, transitional surfaces of the carriage during a discharge cycle of the distribution belt, the distribution belt clutch further designed to disengage the distribution belt during forward reciprocation of the distribution belt and belt carriage, to discontinue rotation of the distribution belt during a loading cycle of the distribution belt.

* * * * *